United States Patent [19]

Fremstad

[11] Patent Number: 4,903,934

[45] Date of Patent: Feb. 27, 1990

[54] PICTURE FRAME FASTENING MEANS

[76] Inventor: Gregory E. Fremstad, 84554 Springfield Creswell Hwy., Pleasant Hill, Oreg. 97455

[21] Appl. No.: 182,220

[22] Filed: Apr. 15, 1988

[51] Int. Cl.[4] ..... A47G 1/16

[52] U.S. Cl. ..... 248/551; 248/495; 248/222.3; 40/152.1

[58] Field of Search ..... 248/544, 551, 553, 475.1, 248/476, 489, 495, 497, 222.3, 500, 503, 503.1; 40/152.1; 24/589, 590; 411/84, 85, 552, 553, 549, 349

[56] References Cited

U.S. PATENT DOCUMENTS

| | | | |
|---|---|---|---|
| 342,194 | 5/1886 | Finnegan et al. . | |
| 1,661,188 | 3/1928 | Matthews . | |
| 2,626,773 | 1/1953 | Backman | 248/222.3 |
| 2,826,388 | 3/1958 | Janos | 411/349 |
| 2,859,710 | 11/1958 | Elsner | 248/222.3 |
| 2,931,471 | 4/1960 | Howard | 411/349 |
| 3,179,367 | 4/1965 | Rapata | 248/222.3 |
| 3,235,219 | 2/1966 | Green | 248/222.3 |
| 3,922,807 | 12/1975 | Shore | 40/152.1 |
| 4,192,478 | 3/1980 | Coules | 248/222.3 |
| 4,222,508 | 9/1980 | Bott | 224/324 |
| 4,385,744 | 5/1983 | Sherman et al. | 248/551 |
| 4,606,526 | 8/1986 | Rabinowitz | 248/475.1 |
| 4,653,708 | 3/1987 | Rich | 248/27.1 |

*Primary Examiner*—Alvin C. Chin-Shue
*Assistant Examiner*—Robert A. Olson
*Attorney, Agent, or Firm*—James D. Givnan, Jr.

[57] ABSTRACT

A wall attached base includes locking members rotatable into overlying relationship with the flanges of a tubular metal frame to confine same adjacent the wall surface. Appendages on the base receive a tool for imparting rotation to the base for moving of the locking members into and out of frame locking positions. Portions of the base frictionally engage the frame to prevent undesired rotation of the base. The frictional portions of the base are yieldable ears formed on the locking members or, in the modified form of the invention, surfaces on the appendages of the base adapted for frictional engagement with the frame. Wall marking pins are provided for temporary installation within each base to precisely mark the wall for installation of screw means.

3 Claims, 1 Drawing Sheet

PICTURE FRAME FASTENING MEANS

BACKGROUND OF THE INVENTION

The present invention pertains generally to concealed fastening means for removably securing a picture frame or its like to a wall surface in a theftproof manner.

Important features of a frame mounting system is that it be concealed from view and that, in commercial uses, discourages theft. Toward these ends U.S. Pat. No. 4,385,744 discloses a frame hanging system utilizing both Z-shaped clips and a companion latching device including an arm which swings into position behind a picture frame flange to prevent frame movement away from an adjacent wall. A cam surface on the arm permits the arm to move in response to the frame during frame movement toward a wall. A tool for frame release from a wall is necessary and with the tool having a right angular end member which requires that the wall attached frame must always be outwardly positionable from the wall surface a distance to permit tool end member insertion. A gap between frame and wall is undesirable from an aesthetic and from a vibration standpoint. Additionally the foregoing system provides no means for marking a wall for precisely locating fasteners during installation.

Other frame installing devices include fasteners with T-shaped heads which are rotated 90 degrees after insertion into a tubular frame channel to prevent frame movement away from a wall.

SUMMARY OF THE PRESENT INVENTION

The present fastening means is embodied within a frame locking device which additionally permits the precise marking of a wall for fastener insertion to preclude installation mistakes.

A base of the present device is shaped so as to admit frame installation thereon and, upon partial rotation, the device occupies the frame channel to prevent frame movement. Appendages of the device permit rotation of the device by a flat tool to reduce unsightly clearance between the frame and a wall. The base is provided with surfaces which sweep into frictional engagement with frame surfaces and require intentionally unlocking effort by a person having an appropriate tool. The base has locking members which occupy internal areas of the frame in one position while rotation of the base permits frame movement past the locking members for frame removal. Unlocking requires an appropriate tool which feature prevents theft of the frame as well as permits minimal spacing between the frame and wall. A modified form of fastening means may be formed from sheet stock with appendages disposed for frictional engagement with the frame flanges to prevent undesired rotation of the base subsequent to mounting of a frame on the wall.

The present fastening means includes an apertured base which temporarily receives a marking pin for indenting of the wall to mark sites for fastener installation. The pins are temporarily carried within a frame to permit marking of the wall by exerted manual pressure on the frame whereafter the pins are removed, the wall drilled and the fasteners installed. The fasteners attach the present frame fastening means to a wall for subsequent reception of the picture frame.

Important objectives include the provision of concealed frame fastening means which permits securement of a picture frame or the like to a wall surface in a theft discouraging manner with the frame and wall surface having minimal spacing therebetween; the provision of frame fastening means wherein the base of the present means additionally serves to temporarily receive pointed pins for marking of a wall to locate sites for fastener installation; the provision of frame fastening means which obviate mistakes made in locating frame fasteners on a wall to avoid wall repair efforts; the provision of frame fastening means produced by high volume-low cost production methods to render fastening means of low cost.

DETAILED DESCRIPTION OF THE PREFERRED EMBODIMENTS

Figure 1:
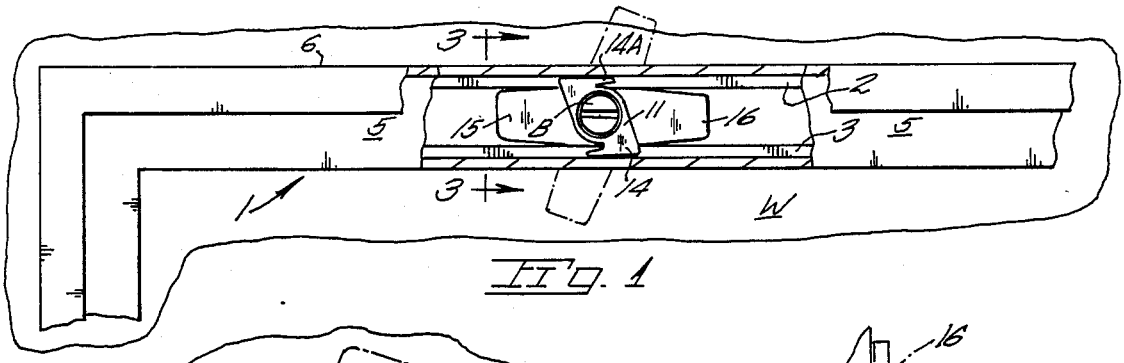
FIG. 1 is a fragmentary frontal elevational view of a tubular picture frame with parts broken away to disclose the present retention means.

With continuing attention to the drawings wherein applied reference numerals indicate components similarly hereinafter identified, a picture frame is indicated generally at 1 which is of the type having a channel partially closed by opposed flanges 2 and 3 to define an open area for the reception of frame mounting means for wall attachment.

The rearward portion of the frame includes the edgewise opposed flanges 2 and 3 for disposition adjacent a wall surface W. The picture frame additionally includes display confining members at 5, 6 and 7 which, for example, hold in place a glass cover 8 and an illustration 9.

The present installation and retention means includes a base 11 which defines a central aperture or bore 12 with a counterbore 13. Locking members 14 on base 11 are adapted for partial rotational positioning or pivoting after insertion into the frame so as to overlie frame flanges 2 and 3 to prevent frame travel away from wall W. Friction means is embodied in projections 14A spaced from axis A of the base and which may flex somewhat to yieldably wipe inner frame surfaces as at 6A to prevent base rotation against all but intentional rotation as later described. Base 11 additionally includes wing-like appendages 15 and 16 which are concealed rearwardly of the picture frame when locking members 14 are disposed in a frame locking position i.e., overlying flanges 2 and 3 per FIG. 1.

A first dimension Y of the base is of lesser magnitude than the distance between edgewise opposed frame flanges 2 and 3 to permit passage of the frame edges past the base. A second dimension at X of the base is of greater magnitude than the first dimension to prevent passage of opposed frame flanges 2 and 3 past the base to lock the frame in place. Rotation of the base, as later described, through approximately a 70 degree arc accomplishes locking and unlocking of the frame.

Figure 2:
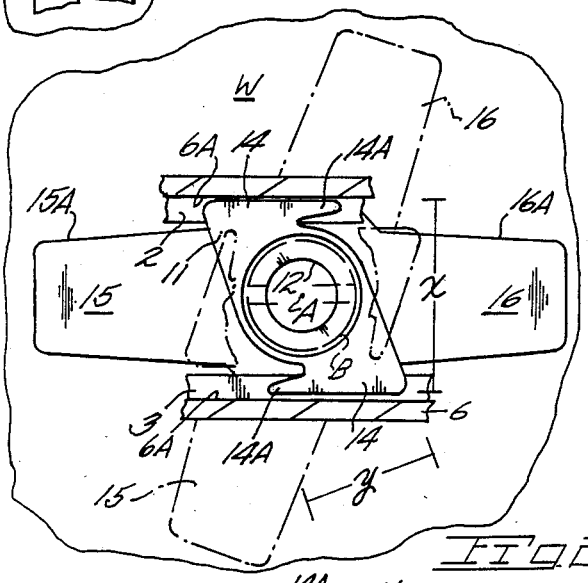
FIG. 2 is an enlarged view of the retention means shown in FIG. 1 with the frame removed.

A base appendage 15 has a tool receiving edge 15A for rotation of the frame retention means to the broken line position of FIG. 2. An appendage 16 has an edge 16A which may receive a fingertip for imparting clockwise movement to same to the full line position of FIG. 2 with perhaps the last few degrees of travel being accomplished with a tool. While the term tool is used, it is to be understood in the broad concept as including any flat or planar body of metal or synthetic material of requisite stiffness to enable imparting forces to edge 15A and optionally to 16A if needed for terminal movement of appendage for concealment rearward of the picture frame. A single appendage on base 11 may suffice but renders base rotation more difficult.

A headed pin P is temporarily housed within counterbored base 11 for the purpose of marking the wall by indentation as later described. The wall is then drilled and a fastener component such as, for example, the insertable portion of an expandable fastener assembly inserted. A screw B of the expandable assembly is then used, after pin removal, to occupy a base aperture 12 to rotatably secure in pivoted fashion the base of the installation and retention means in place on the wall.

With attention to the modified form of the frame retention and installation means shown in FIG. 6 through FIG. 9 wherein prime reference numerals indicate parts earlier identified by like base reference numerals, a picture frame is indicated generally at 1'. Edgewise opposed frame flanges at 2' and 3' define a width therebetween permitting reception of a base 11' in one position and, upon base repositioning, prevention of frame movement away from the wall as locking members at 14' will then overlie frame flanges 2' and 3'. A base aperture 12' received pin P' pointed at one end for the purpose of wall marking by indentation and subsequently is replaced by a screw (or other fastener) for base attachment to a wall.

Figure 6:
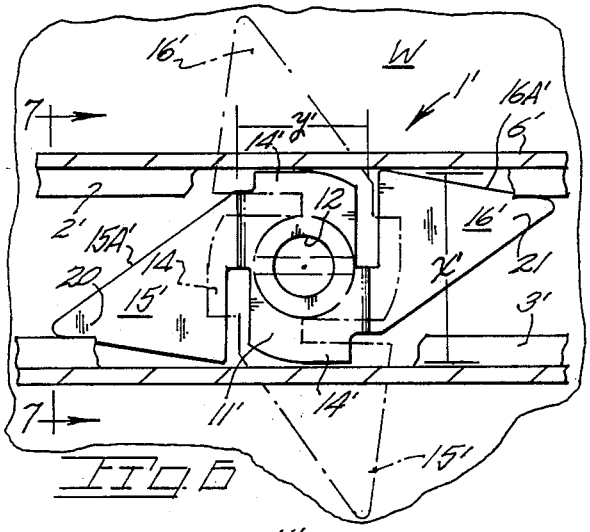
FIG. 6 is a front elevational view of a modified retention means with a picture frame shown in fragmentary form.
Figure 9:
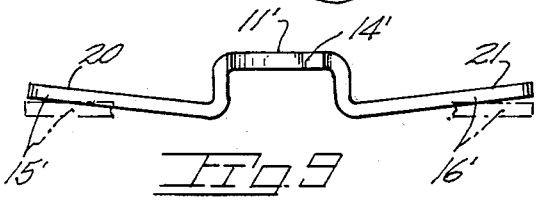
FIG. 9 is a bottom plan view of FIG. 6 with the frame fragment removed.

Appendages at 15'–16' are shown as being of triangular configuration and inclined, as viewed in FIG. 9, toward the rearward surfaces of flanges 2' and 3' to frictionally engage same when the appendages are rotated to a concealed locking position behind said flanges per the full line position of FIG. 6. The flange engaging surfaces 20–21 of the appendages 15'–16' constitute friction means for frictional engagement with said flanges preventing all but intentional arcuate movement of the appendages. During passage past flanges 2'–3', the appendages will flex to the FIG. 9 broken line position and thereafter resume the dihedral shown in full lines in FIG. 6.

Figure 4:
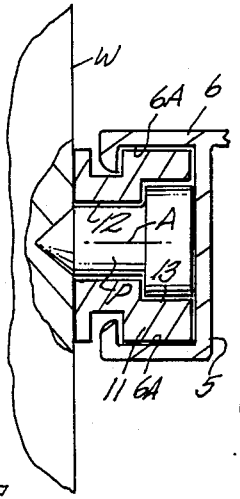
FIG. 4 is a view similar to FIG. 3 but with the retention means shown in section to disclose a pin member temporarily housed therein during wall marking.
Figure 3:
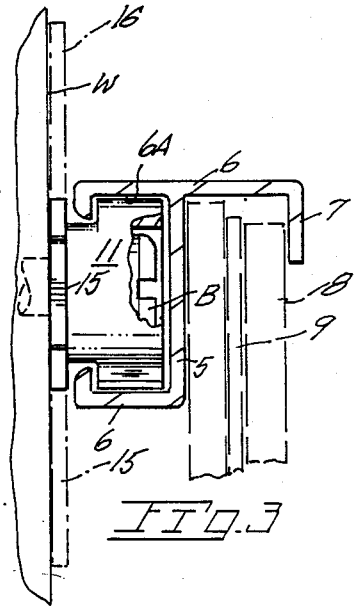
FIG. 3 is a side elevational view taken along line 3—3 of FIG. 1.
Figure 5:
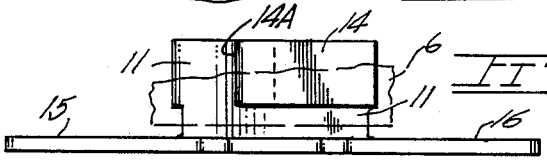
FIG. 5 is a bottom plan view of FIG. 2.
Figure 8:
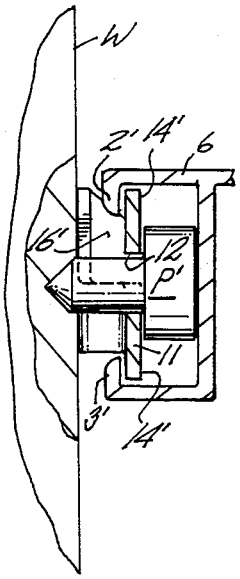
FIG. 8 is a view similar to FIG. 7, but showing a pin member temporarily mounted within the frame for wall marking purposes.
Figure 7:
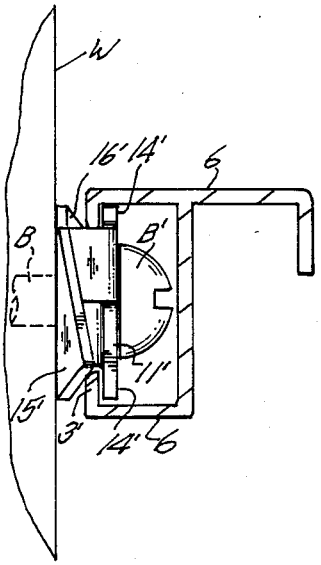
FIG. 7 is a vertical sectional view taken along line 7—7 of FIG. 6.

In use, the frame 1 is provided with a plurality of retention and installation means within each of which is temporarily carried a pin P–P' as shown in FIG. 4 and FIG. 8. Manual force applied to the frame causes the pin points to indent the wall at each pin location. The installation and retention means are then removed from the frame. A fastener, such as of the expandable type, is installed with the bolt B thereof rotatably securing in pivoted fashion the retention and installation means in place. With the installation and retention means rotated to the broken line position of FIG. 2, FIG. 6 in the modified form, the frame is installed in place so as to encompass said means with subsequent rotation concealing the appendages rearward of the picture frame.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

I claim:

1. Picture frame installation and retention means for removably securing frames of channel section having edgewise opposed flanges to a wall surface in a concealed manner, said means comprising, an elongated multisided base including an appendage having an edge for momentary engagement with a tool for rotation of the base, screw means for rotatably attaching said base to a wall, and said base having an aperture through which said screw means extends for rotatably mounting of the base on the screw means, said base including a locking member having a pair of opposite sides shorter than a remaining pair of opposite sides, said remaining pair of opposite sides having recesses therein, said locking member having a first dimension permitting base entry into the area between said opposed flanges for frame unlocking and a second dimension of greater magnitude than said first dimension for overlying said opposed flanges of the frame to lock the frame to prevent horizontal movement of the frame away from wall, projections of a flexible nature defined by said recesses for yieldable wiping engagement with the frame interior to inhibit base rotation.

2. The installation and retention means claimed in claim 1 wherein said base is counterbored to receive said screw means in a recessed manner.

3. Frame retention and installation means for a wall attachable frame having edgewise opposed flanges, said means comprising in combination, a multi-sided base defining an aperture and adapted to be manually rotatably positioned and including a locking member positionable to overlie one of the frame flanges to prevent frame movement away from a wall surface, at least one appendage on said base, a pair of oppositely directed projections on said locking member of a flexible nature for momentary wiping engagement with the frame during installation to prevent unintentional counter-rotation of the base, screw means extending freely through said aperture for rotatably attaching said base to said wall, said one appendage having an edge to receive a tool for imparting rotation to move the locking member of the base into and out of overlying relationship with one of the frame flanges, and said base having a first dimension and a second dimension respectively lesser and greater magnitude than the distance between said flanges of the wall attachable frame to permit frame passage past said base and alternately block passage of the frame past said base.

* * * * *